United States Patent [19]

Lang et al.

[11] 4,189,982

[45] Feb. 26, 1980

[54] FEED PRESSURE BYPASS VALVING FOR SERVOMOTORS

[75] Inventors: Armin Lang, Schwäbisch Gmünd-Bettringen; Rolf Fassbender, Mutlangen, both of Fed. Rep. of Germany

[73] Assignee: Zahnradfabrik Friedrichshafen AG, Friedrickshafen, Fed. Rep. of Germany

[21] Appl. No.: 756,738

[22] Filed: Jan. 4, 1977

[51] Int. Cl.[2] ..... F15B 15/20

[52] U.S. Cl. ..... 91/400; 251/321

[58] Field of Search ..... 91/400 X; 137/115, 116, 137/116.3; 251/77, 321

[56] References Cited

U.S. PATENT DOCUMENTS

| | | | |
|---|---|---|---|
| 2,192,141 | 2/1940 | McElwaine | 251/321 |
| 2,600,650 | 6/1952 | Hieger | 251/77 |
| 2,872,149 | 2/1959 | Battey et al. | 251/77 |
| 3,035,596 | 5/1962 | Gunard | 137/116 |
| 3,036,809 | 5/1962 | Kerr | 251/77 |
| 3,074,433 | 1/1963 | Stark | 251/77 |
| 3,092,083 | 6/1963 | Sheppard | 91/401 |
| 3,276,547 | 10/1966 | Müller et al. | 251/321 |
| 3,389,886 | 6/1968 | Tissot-Dupont | 251/77 |
| 3,395,722 | 8/1968 | Heinrich | 137/115 |

FOREIGN PATENT DOCUMENTS

| | | | |
|---|---|---|---|
| 1926861 | 12/1970 | Fed. Rep. of Germany | 91/341 R |
| 1240945 | 8/1960 | France | 251/321 |

*Primary Examiner*—Martin P. Schwadron
*Assistant Examiner*—G. L. Walton
*Attorney, Agent, or Firm*—Zalkind & Shuster

[57] ABSTRACT

A feed pressure bypass valve means and actuator means primarily for a single acting servomotor, is provided having a unitary housing construction and an assembly of opposed springs wherein one spring biases a bypass valve to closed position and the other spring is compressed by the servometer piston to act in the opposite direction. The bypass valve is mounted externally of the servomotor as a separate and integral unit and has for its purposes to ensure maintaining a drop in feed pressure as the piston nears the end of its stroke. The provision of the spring compressed by the piston toward the end of the stroke ensures the opening and maintenance of opening of the bypass valve. There can be no instability of steering operation by virtue of the bypass valve closing and the striking of the servomotor cylinder wall by the piston is precluded.

7 Claims, 2 Drawing Figures

FIG. 1
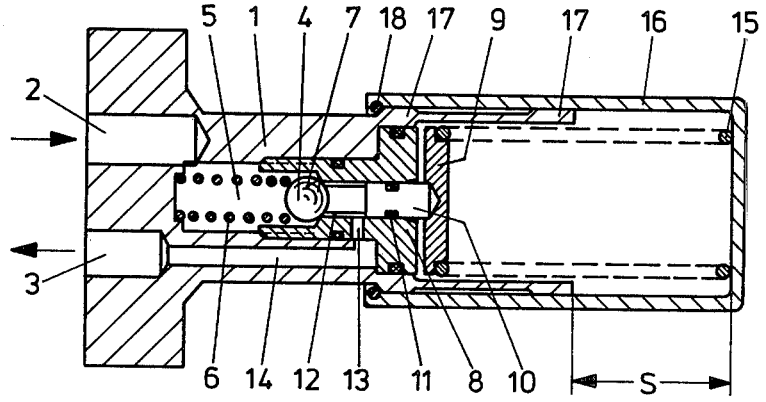
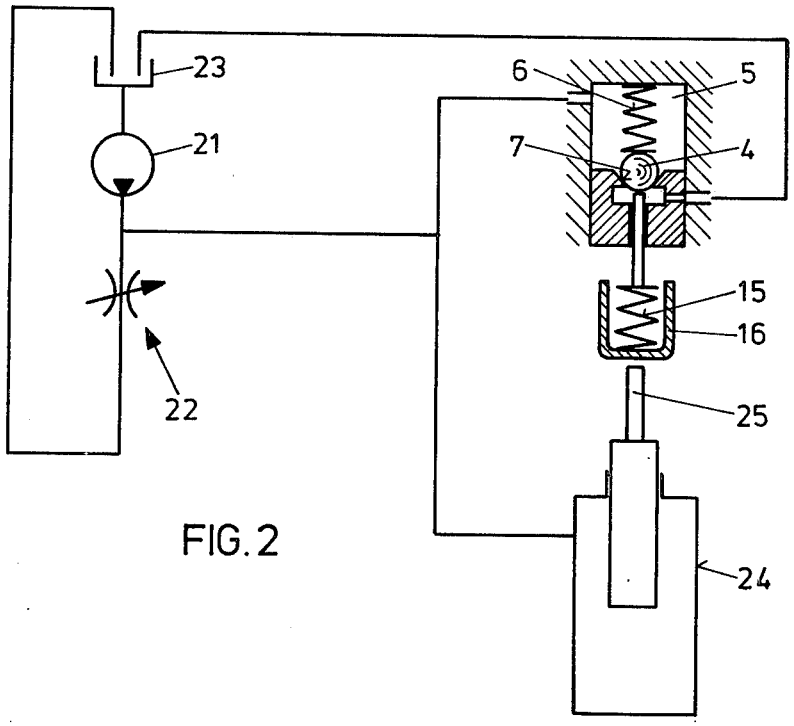
FIG. 2

FEED PRESSURE BYPASS VALVING FOR SERVOMOTORS

The field of use of this invention is in systems where feed pressure moving a servomotor piston is released as the iston approaches the end of a stroke wherein the piston activates a bypass or shunt valve which directs pressure flow to a sump.

Prior art patents in this field as known to applicant are:

| | | |
|---|---|---|
| Sheppard | 3,092,083 | June 1963 |
| Jablonsky et al | 3,242,824 | March 29, 1966 |
| Jablonsky et al | 3,252,380 | May 1966 |
| Symons et al | 3,385,389 | May 1968 |
| Lang | 3,878,763 | April 22, 1975 |
| Allen | 3,566,749 | March 1971 |

Cross reference is made to assignee's copending applications of Liebert, Ser. No. 702,451, filed July 6, 1976 and Lang now U.S. Pat. No. 4,023,363, Ser. No. 756,794, filed Jan. 4, 1977.

In certain prior art devices the systems are such that the servomotor piston may momentarily spring back from the direction it is moving after activating a bypass valve to open a shunt flow to a sump, thus causing closing of the valve and an undesirable vibrating effect due to pressurizing of the piston when the valve closes since shunt flow is cut off.

In the present invention an interposed compression spring is compressed to open the bypass valve by the piston to a distance greater than the spring back distance of the piston. This ensures that once opened, the valve will remain open despite spring back effect acting on the piston. The arrangement is effected in a unitary housing exteriorly of the servomotor.

A detailed description of the invention now follows in conjunction with the appended drawing in which:

FIG. 1 is a longitudinal section of the assembly of the bypass valve, and

FIG. 2 is a diagram illustrating the coaction of the bypass valve with a single acting servomotor.

Referring to FIG. 1, the bypass valve comprises a cylindrical elongated body effecting a housing 1 having a base flange, as shown, understood to be for attachment to an appropriate portion of a vehicle body and through which flange is a pressure feed bore 2 and exhaust bore 3, for connecting, respectively, to a servopump and an oil sump. The housing has a bore 5 for a bypass valve means, encompassing a bias spring 6 which biases ball valve head 4 to normally closed position against a valve seat 7 provided as a ledge in a sleeve 8 threadedly secured in the housing bore. Bore 2 connects with bore 5 upstream of the valve head and bore 3 connects downstream via annular recess 12 and radial bore 13 to channel 14, in sleeve 8 and housing 1, respectively.

Radial recess 12 is formed concentrically as a spacing between a thrust member, such as actuating pin 10, and the inner surface of the sleeve. The pin 10 has a sliding and sealed fit within the sleeve, O-ring seal 11 being utilized for sealing, and is maintained in engagement with the valve head by a prestressed compression spring 15 acting through a thrust plate 9. The pin has a conical tip force fitted in plate 9, as shown, the plate acting at one end of spring 15 to hold it in compression against the closed end of an actuator means, e.g., an element such as a cup 16 which encompasses the spring.

Thus, spring 15 is totally retained within the skirt effected at the open end of the housing and the telescopic cup 16.

Cup 16 is telescopically slidable on the elongated housing body, guided on the spaced enlarged circumferential portions 17 and retained by ring clip 18 so as to retain spring 15 in prestressed compression dominated by spring 6 to maintain engagement of valve head and seat.

As hereinabove indicated, springs 6 and 15 are of a spring rate such that spring 6 is the stronger in the prestressed state whereby the bypass valve means is normally closed. However, spring 15 can be compressed, e.g., for the distance "S", to the point where it overcomes spring 6 as well as overcoming the pressure existing upstream of the valve head 4 so as to separate it from the valve seat 7, plate 9 moving a restricted distance to abut the end flange of sleeve 8 while the thrust member, or, actuating pin 10 opens the valve.

Accordingly, as will be obvious, feed pressure will then flow from pressure bore or passage 2 to exhaust bore, or, passage 3, through valve seat 7, recess 12 and bore 13.

Referring now to FIG. 2, wherein like reference numerals designate components described in FIG. 1, a servopump 21 draws oil from sump 23 and connects to the single acting servomotor 24 and to passage 2. Servomotor 24 is pressurized on closing valve 22 and depressurized on opening valve 22, a conventional arrangement. The servomotor piston has an exterior rod means 25 abuttable with cup 16 at what will be understood to be a desired point towards the end of the piston travel to actuate the bypass valve means whence feed pressure passes therethrough to sump 23 relieving booster feed.

In the event of spring back of the piston, the residual compression in spring 15 will maintain the valve head and valve seat open, it being noted that only the bias of spring 6 need be overcome since feed pressure no longer acts on the valve head due to its being open.

It will be understood that full retraction of the servomotor piston is effected in any conventional manner for single acting cylinders after the opening of valve 22 to shunt feed pressure from pump to sump. The rod means 25 then separates from cup 16 and the bypass valve means closes when spring 15 compression is reduced to the initial prestressed state, such closure being under force of dominant spring 6. Feed pressure once again adds to maintenance of closure when valve 22 is closed for once again pressurizing the servomotor.

Although the invention is illustrated in conjunction with a single acting servomotor, it will be understood that it is not thus restricted, but is usable with systems using double acting servomotors.

We claim:

1. In a feed pressure bypass valve means actuatable by the piston of a servomotor, the improvement comprising a valve (4, 7) and bias spring (6) biasing said valve to closed position; having valve actuator means (15, 16, 9, 10) comprising an actuator spring (15); said valve actuator means being disposed to be engaged by piston movement wherein said actuator spring is compressed in opposition to the bias spring;

said valve actuator means being operative by force of predetermined compression in said actuator spring (15) to overcome the bias of said bias spring (10), to initiate and to continue the opening of said valve responsive to movement of said piston toward the end of a stroke;

a housing (1) for said bypass valve means having support structure (17) for said valve actuator means whereby said bypass valve means effects a unitary device independently mountable;

said housing having an inlet passage means (2) for conducting feed pressure to said valve upstream in the closing direction thereof and having outlet passage means (3) connecting to said valve downstream thereof wherein feed pressure is operative as a bias force in the closing direction of said valve.

2. A feed pressure bypass valve means as set forth in claim 1, said bypass valve means comprising a sleeve in a bore of said housing and said valve comprising a valve head and a valve seat in said sleeve;

a thrust member sealingly slidable in said sleeve and means whereby said thrust member is maintained in engagement with said valve head through said valve seat by said actuator spring.

3. A feed pressure bypass valve means as set forth in claim 2, said housing having an elongated body shape and said actuator means comprising an actuator element in the form of a cup telescopically slidable on said housing and encompassing said actuator spring;

said housing having an open end effecting a skirt encompassing said actuator spring; whereby said actuator spring is totally encompassed by said cup and said skirt.

4. A feed pressure bypass valve means as set forth in claim 2, said thrust member being a pin slidably sealed in said sleeve; said outlet passage means comprising a portion of reduced diameter of said pin abutting said valve head and effecting a flow spacing within said sleeve downstream of said valve and further comprising a radial bore through said sleeve connecting with said spacing and still further comprising a passage in said housing connecting with said radial bore for egress of bypass flow from said housing.

5. In a feed pressure bypass valve means actuatable by the piston of a servomotor, the improvement comprising a valve (4, 7) and bias spring (6) biasing said valve to closed position; having valve actuator means (15, 16, 9, 10) comprising an actuator spring (15); said valve actuator means being disposed to be engaged by piston movement wherein said actuator spring is compressed in opposition to the bias spring;

said valve actuator means being operative by force of compression in said actuator spring to overcome the bias of said bias spring to open said valve upon predetermined extent of movement of said piston toward the end of a stroke;

a housing (1) for said bypass valve means having support structure (17) for said valve actuator means whereby said bypass valve means effects a unitary device independently mountable;

said housing having an inlet passage means (2) for conducting feed pressure to said valve upstream thereof and having outlet passage means (3) connecting to said valve downstream thereof wherein feed pressure is operative to act in the closed direction of said valve;

said valve actuator means (20) having an actuator element (9, 16) actuatable by servomotor movement and telescopically slidable relative to said housing when actuated to compress said actuator spring;

a bore (5) in said housing;

said valve comprising a valve seat (7) in said bore and a valve head (4) normally closing said valve seat by bias of said bias spring;

thrust transmitting means comprising a thrust member (10) in said bore and having a sliding sealed fit therein and being operative upon being actuated to separate said valve head from said valve seat thereby opening said valve;

said thrust transmitting means further comprising means (9) for transmitting compressive force of said actuator spring to said thrust member to effect said opening.

6. A feed pressure bypass valve means as set forth in claim 5, said latter means comprising a thrust plate abutted by one end of said actuator spring and integrally secured to said thrust member.

7. A feed pressure bypass valve means as set forth in claim 5, said housing having an elongated body shape and said actuator element being a cup telescopically slidable thereon and encompassing said actuator spring.

* * * * *